United States Patent [19]

Broadhurst

[11] Patent Number: 4,862,135

[45] Date of Patent: Aug. 29, 1989

[54] RESISTOR HOLDER

[75] Inventor: John H. Broadhurst, Golden Valley, Minn.

[73] Assignee: Sysmed, Inc., Golden Valley, Minn.

[21] Appl. No.: 250,609

[22] Filed: Sep. 29, 1988

[51] Int. Cl.[4] ..... H01C 1/06

[52] U.S. Cl. ..... 338/64

[58] Field of Search ..... 338/64, 60, 61, 226, 338/230; 336/84; 174/35 R, 35 C

[56] References Cited

U.S. PATENT DOCUMENTS

| | | | |
|---|---|---|---|
| 2,361,405 | 10/1944 | Kopple | 338/64 X |
| 2,958,061 | 10/1960 | Keepler et al. | 338/64 |
| 3,239,751 | 3/1966 | Sibary | 338/64 X |
| 3,784,950 | 1/1974 | Coffman | 338/64 X |

*Primary Examiner*—E. A. Goldberg
*Assistant Examiner*—M. M. Lateef
*Attorney, Agent, or Firm*—Herman H. Bains

[57] ABSTRACT

A resistor device for use with electrostatic particle accelerators includes a resistor element positioned within a tubular housing having a fixed end cap at one end thereof and a movable end cap at the other end thereof. The tubular housing, fixed end cap, and movable end cap serve as an electromagnetic field for the resistor element. Conductive disks engage opposite ends of the resistor element and concentrically position the resistor element within the tubular housing. Helical springs engage the conductive disks and the end caps to yieldably support the movable end caps and resistor element for yieldable axial movement relative to the tubular housing. An annular conducting ring is secured to the tubular housing and is spaced radially from the movable end cap and cooperates with the latter to define an annular spark gap.

9 Claims, 1 Drawing Sheet

RESISTOR HOLDER

FIELD OF THE INVENTION

This invention relates to electrical resistors and, more particularly, to electrical resistors for use in the presence of severe electrical transients.

BACKGROUND OF THE INVENTION

Normally electrical resistors can be used in most applications without further protection. Usually, resistors are attached to terminal strips by soldering their connecting leads or, alternatively, high power resistors are mounted at each end by metallic retaining clips. When used in a high voltage environment, further improvement of the electrical insulation in the vicinity of the resistor is often added by oil immersion, or, more recently, by the use of insulating gases, such as sulphur hexafluoride, at higher pressure. This simple approach is inadequate for long chains of resistors which are used as voltage dividers in electrostatic particle accelerators.

Typically, an electrostatic particle accelerator with a 10 megavolt terminal potential will have two series strings, each of 300 resistors between the high voltage terminal and ground potential. At the junction of each resistor with its neighbor, connection is made to one of the accelerating elements of the accelerator. Under steady state conditions, the potential difference across the ends of each resistor will be equal to the terminal potential, divided by the number of resistors in the dividing chain. It, therefore, seems trivial to select from resistor manufacturer's charts resistors with working potential differences equal to or greater than the potential difference per resistor, as calculated above.

However, electrostatic accelerators develop spark discharges, both local to a few elements of the accelerating structure (i.e., between one of two accelerating electrodes), or in general to the whole accelerator by means of a spark from the high voltage terminal to the ground potential wall of the surrounding pressure vessel. During spark discharges, the uniform division of potential from terminal to ground is interrupted, and the transient potential division is determined by the capacitive and inductive structure of the accelerator column. Two main processes occur during spark discharges. One is that, since most accelerators are made from cylindrical insulating columns surrounded by a cylindrical metallic pressure vessel, their behavior is that of a coaxial cable shorted at the ground potential end. When a terminal to vessel discharge occurs, a wave then propagates down the column to the ground end where, due to the column-pressure vessel short circuit, it is reflected with opposite polarity, and returns once more to the terminal. As the terminal is, from the radio frequency viewpoint, an open circuit, the wave then reflects at the same polarity towards the tank end. This process continues until the energy stored in the electric field of the accelerator is dissipated as heat in the various protective spark gaps.

The second process, not appreciated in the early days of accelerator design, is that the spark represents a very rapidly changing current flow, typically 50,000 amps in one microsecond. This current flow generates an intense field of radio frequency electromagnetic energy, which produces large transient potentials across the conducting elements of the mechanical structure, which normally would be regarded as equipotentials. In particular, the electromagnetic energy pulse can cause large transient potentials to appear between the turns of the helix of the resistive track of the resistor, which results in turn-to-turn sparking within the resistor. This produces damage to the resistance track.

Protection from these problems was offered in electrostatic particle accelerator draft designs by the use of button spark gaps, which were inherited from the electric power industry. These button spark gap mechanisms were often mounted remote from the resistor it was to protect because it was thought that a metallic connection represented an equipotential and, thus, would protect the resistor adequately. However, this was shown not to be the case, and most electrostatic particle accelerators to this day need replacement of their resistive elements due to overvoltage damage during spark transients.

The first improvement was realized by Daresbury Laboratories in the United Kingdom, which was charged with the development of a superscale accelerator (intended to work at 35 MV terminal potential). The personnel at Daresbury Laboratories found that their grading resistors, mounted in the open and soldered onto lugs mounted at the edges of insulating boards in the power engineering tradition, were destroyed to a large part by a single spark discharge. However, by surrounding the resistors with a conducting screen, this nearly eliminated their problem, even though the screens were not directly associated with the electrical circuits of the resistor. These screens attenuated the radio frequency electromagnetic pulse. Since that time, many different resistor enclosure designs have been produced, with varying degrees of success and most of the new accelerator designs incorporate at least some enclosure for their resistors.

As of the present, the main improvement in resistor design has been to provide a conducting shield to prevent the radio frequency energy from producing large transient potential differences locally along the length of the resistor. These measures have improved the resistor durability many-fold, but have not achieved the lifetimes approaching the steady state lifetimes guaranteed by the manufacturers. For example, upwards of 2,000 resistors are used in large electrostatic particle accelerators. When all of these resistors have aged (i.e., from new), then statistical failure will occur in the example given at 2,000 times the failure rate of a single resistor.

Failure can occur in two ways; namely, the sudden change of the resistor to an open circuit, often accompanied by mechanical disintegration, and the gradual change in resistance value, which distorts the potential distribution along the length of the electrostatic particle accelerator. From keeping records of sparkover, it is obvious that damage is still being produced by spark discharge of the accelerator, as the accelerators operated conservatively suffer little resistor damage (would produce less useful operation time), while accelerators operated aggressively suffer frequent resistor replacement problems. As other developments in the accelerator technology increase the maximum terminal potential available on an accelerator of a given size (enhancing the maximum stored energy), the problem of resistor damage has again become more acute. Derating (that is employing resistors of larger physical size, and, therefore, with higher manufacturer's rating for the maximum applied potential difference), although helpful, does not completely alleviate the problem of early failure. This palliative technique also increases the space that must be devoted for grading resistors, thus restricting the design of more compact accelerators.

SUMMARY OF THE INVENTION

It is an object of this invention to provide a novel resistor device for use with electrostatic particle accelerators or the like, which include a complete electromagnetic shield for the resistor element to thereby minimize damage to the resistor element in the presence of severe electrical transients.

Another object of this invention is to provide a novel resistor device, which is arranged and constructed to define a spark gap comprised of an outer spark gap ring that can be initially altered in dimension to enable the breakdown potential to be set appropriately for the resistor used, even when the resistor device is employed in electrostatic particle accelerators using different insulating gases at different operating pressures.

A further object of this invention is to provide a novel and improved resistor device, which includes a spring-loaded end cap that permits ready insertion of the resistor device into a simple holder, thereby avoiding mechanical complexity in installing the resistor device into an electrostatic particle accelerator structure. Further, the resistor device may be readily demounted from the accelerator structure, thereby permitting a faulty resistor to be quickly replaced without the necessity of providing a new shielding structure.

FIGURES OF THE DRAWING

DESCRIPTION OF PREFERRED EMBODIMENT

Figure 3:
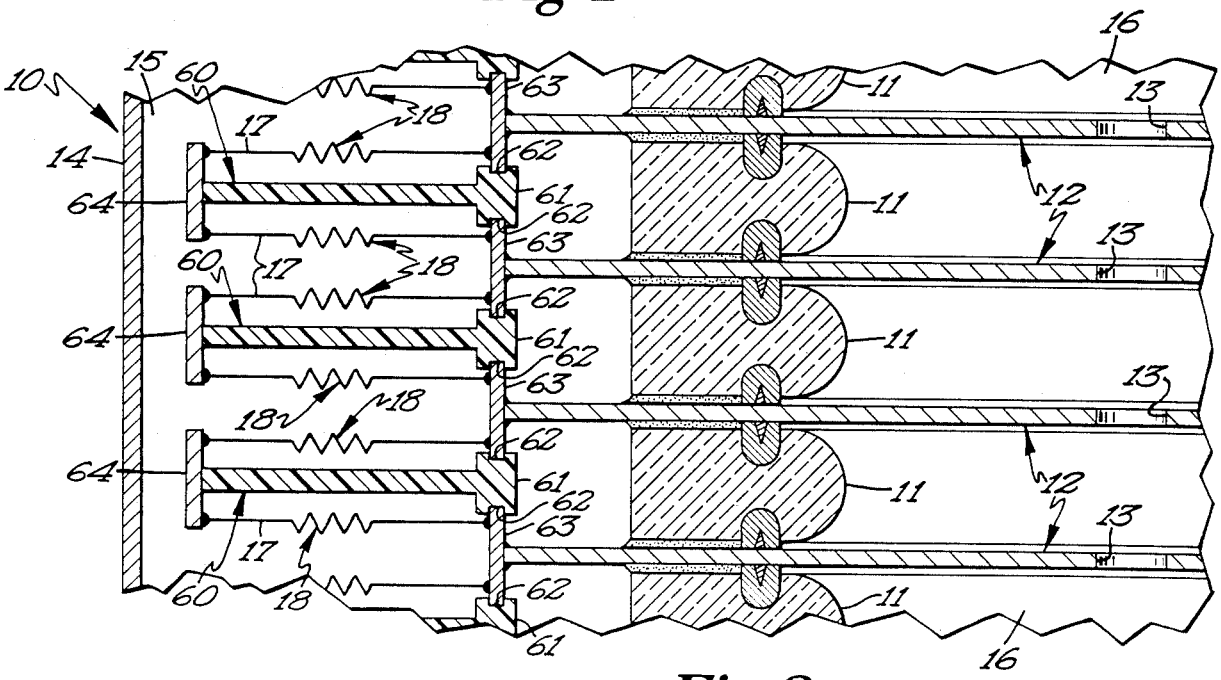
FIG. 3 is a diagrammatical cross-sectional view of a portion of an electrostatic particle accelerator, illustrating another manner in which the novel resistor devices are incorporated in the accelerator circuit.

Referring now to the drawings and, more particularly, to FIG. 3, it will be seen that an electrostatic particle accelerator, designated generally by the reference numeral 10, which incorporates the novel resistors, is thereshown. The electrostatic particle accelerator is of tubular or cylindrical configuration and includes a plurality of similar annular accelerating tube insulators 11 which are disposed between and engage accelerating tube metal electrodes 12. Each of the electrodes 12 has a centrally located aperture 13 therein through which the accelerated ions pass. The particle accelerator 10 is also provided with an external metallic jacket or housing 14, which is radially spaced outwardly from the accelerator tube and defines therewith a chamber 15 which contains an insulating gas, such as sulfur hexafluoride at high pressure.

It will be seen that a plurality of grading resistors 18 are interconnected in series by electrical conductors 17, and these grading resistors function as voltage dividers in the electrostatic particle accelerator 10. In this regard, it will be seen that a pair of grading resistors 18 are connected across a pair of adjacent accelerating electrodes 12.

Figure 1:
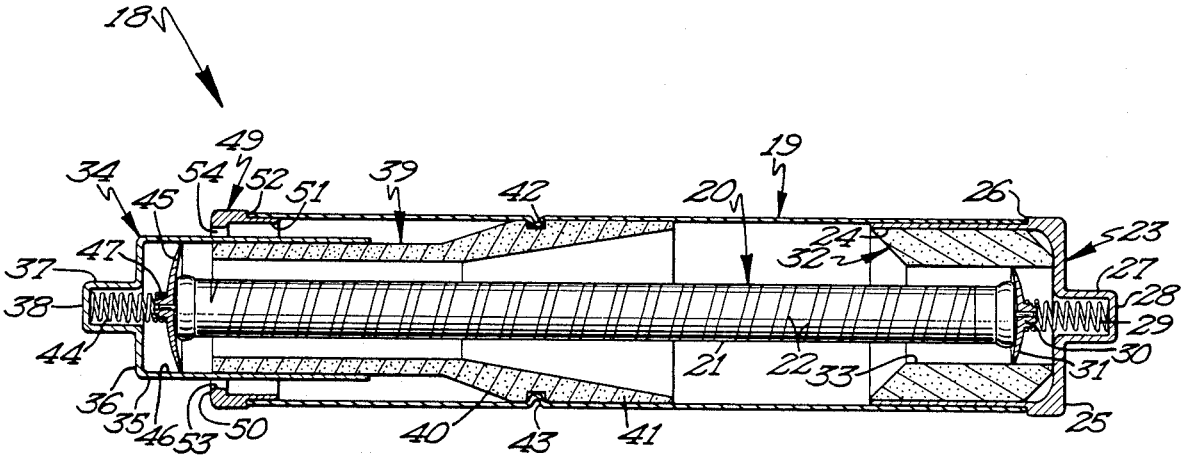
FIG. 1 is a cross-sectional view of the novel resistor device, illustrating details of construction thereof.

Referring now to FIG. 1, it will be seen that each resistor device 18 is comprised of an elongate cylindrical tubular casing 19 formed of stainless steel or similar material and having a conventional commercial cylindrical resistor element 20 positioned concentrically therein and spaced radially therefrom. The resistor element 20 includes an elongate cylindrical ceramic body having a conductor wound thereon to define turns or windings 22, all of which is of conventional resistor design configuration.

The grading resistor device 18 is provided with a cylindrical fixed end cap 23 at one end thereof, and the fixed end cap includes a cylindrical portion 24 and an end wall 25 at one end thereof. It will be noted that the end wall has a slightly greater thickness dimension than the cylindrical portion 24 and cooperates therewith to define an external annular shoulder 26, which is engaged by one end edge of the tubular casing 19. In this regard, it will be noted that the exterior surface of the cylindrical portion 24 is positioned within and spot welded to the tubular casing 19.

The fixed end cap is also provided with a reduced cylindrical portion 27 projecting axially from the end wall 25 and terminating in an end wall 28. A helical spring 29 projects into the reduced cylindrical portion 27 and has one end thereof disposed in bearing engagement with the end wall 28. The other end of the spring 29 engages a disk 31, which is formed of a conducting material. The disk 31 has a hub 30 integral therewith, which projects axially therefrom into the other end of the spring 29. The disk 31 is soldered to the end wires of the resistor 20 to form an electrical connection therewith.

It will be seen that a cylindrical insulating bushing formed of a non-conductive material is positioned within the fixed end cap 32. It will further be seen that the circumferential edges of the conducting disk 31 engage the inner circumferential surface 33 of the insulating bushing to center the disk relative to the casing 19 and to permit sliding movement of the disk relative to the bushing.

The grading resistor 18 is also provided with a cylindrical movable end cap 34, which includes a cylindrical portion 35 and an end wall 36. The movable end cap 34 is also provided with a reduced cylindrical portion 37 which terminates in an end wall 38. The movable end cap 34 is slidable on a cylindrical insulator 39, which is positioned within the tubular casing 19, and which flares outwardly and terminates in an enlarged cylindrical portion 41. The enlarged cylindrical portion of the insulator 39 has an annular recess 42 in the exterior surface thereof for accommodating a retaining element 43 of the tubular casing 19. The retaining element 43 is formed by dimpling the tubular casing 19 inwardly.

A helical spring 44 is seated within the reduced cylindrical portion 37 and has one end thereof bearing against the end wall 38 and has its other end thereof engaging a disk 45 formed of conductive material. The periphery of the disk slidably engages the inner circumferential surface 46 of the movable end cap 34. The disk 45 is also provided with a hub 47, which projects axially therefrom and into the spring 44. The disk 45 is also soldered to the end wires of the resistor 20 so that the disk, spring 44, and movable end cap are electrically connected to the resistor. The disks 31 and 47 cooperate with each other to center the resistor element 20 relative to the tubular casing 19.

A detachable conductor ring 49 is secured to one end of the tubular casing 19 adjacent the movable end cap 34. The conductor ring 49 includes a ring element 50 and a cylindrical portion 51 projecting axially therefrom. The thickness dimension of the ring element 50 is slightly greater than the thickness dimension of a cylindrical portion 51 to thereby define an annular shoulder 52. The cylindrical portion is positioned within and spot welded to the tubular casing 19, and the latter engages the annular shoulder 53. It will be noted that the ring element 50 has an inwardly projecting annular lip spaced from the cylindrical portion 35 of the movable end cap 34 to define a spark gap 54 therebetween.

It will be seen that the tubular casing 19, the fixed end cap 23, and the movable end cap 34 cooperate with each other to present a complete electromagnetic shield for the resistor element 20. There is absolutely no exposure of the resistor, except as seen through the annular spark gap 54.

It will also be noted that the detachable conductor ring 49 functions as the spark gap outer element during operation of the electrostatic particle accelerator. Since the conductor ring 49 is separately attached to the tubular casing during assembly of the resistor device, the ring can be easily and readily altered in dimension during assembly to enable the breakdown potential to be set appropriately for the resistor used, even when the resistor devices employ accelerators using different insulating gases at different operating pressures.

Figure 2:
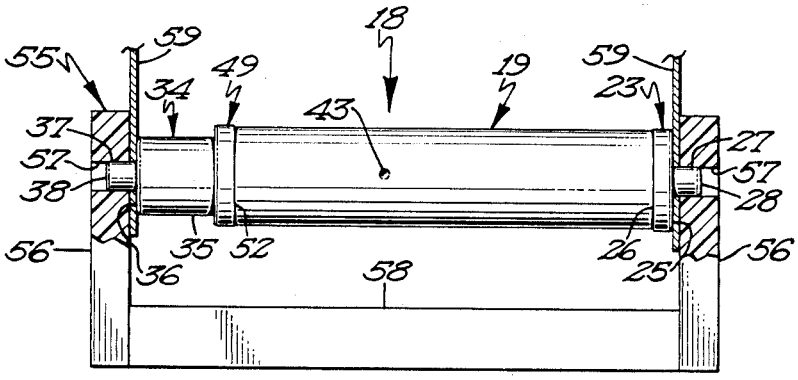
FIG. 2 is a side elevational view illustrating one manner in which the novel resistor device is mounted in a holder.

Referring now to FIG. 2, it will be seen that one embodiment of a resistor holder device, designated generally by the reference numeral 57, is illustrated in supporting relation with respect to my novel grading resistor 18. It will be appreciated that several holder devices 57 will be positioned within the chamber 15 of the accelerator 10 and mounted therein in any suitable manner. Each holder device 55 includes a pair of spaced apart Lucite posts 56, each having an opening 57 therethrough, and each being interconnected at one end thereof by a conductive metallic strip 58. It will be seen that the reduced end portions of the fixed and movable end caps are positioned in the openings 57 and are electrically connected to conductive metallic strips 59, which are interconnected to adjacent pairs of electrodes 12 of the particle accelerator 10. Each grading resistor is, therefore, connected across a pair of adjacent electrodes, and the grading resistors are connected in series to each other.

Referring now to FIG. 3, it will be seen that the electrostatic particle accelerator 10 is diagrammatically illustrated, and a different arrangement of the holder devices for supporting the grading resistor device is thereshown. In the arrangement illustrated in FIG. 3, a pair of grading resistors 18 are connected across a pair of adjacent electrodes 12 of the particle accelerator 10. A Lucite post or bar 60 is provided with an enlarged generally rectangular-shaped end portion 61 having a pair of recesses or notches 62 therein. These recesses 62 in the end portion 61 each accommodate one end portion of a metal bar 63. Each metal bar is welded or otherwise affixed to one of the electrodes 12 and projects axially therefrom in opposite directions.

The Lucite bar 60 also has an axially extending metal bar 64, rigidly secured to the other end thereof. Each of the metal bars 63 and 64 have a pair of spaced apart openings therein and each opening accommodates the reduced end portion of one of the end caps for a grading resistor 18. It will, therefore, be seen that a pair of grading resistors 18 are connected across each pair of adjacent electrodes 12, and the grading resistors are connected in series.

It will also be seen that, since the movable end cap is spring-loaded, the resistor device can be readily attached or easily inserted into a simple holder, thereby avoiding mechanical complexity ordinarily associated in installing the resistor device into an accelerator structure. Conversely, since the resistor device is readily demountable, a faulty resistor element can be quickly removed from the casing and easily replaced without incurring the expense of a new shielding structure.

These structural features provide mechanical advantages not found in prior art grading resistors for electrostatic particle accelerators. Further, my novel resistor device also possesses electrical properties which are not present in prior art resistors.

In this regard, my novel resistor device serves to control the axial electrical field strength along the resistor surface at all times, including both steady state operation and operation during severe electrical transients. During steady state operation, the axial field strength is controlled by choosing an appropriate length resistor for the required potential difference across one electrode pair in the accelerator system. It must be appreciated that the spark gap must have a gap dimension so that, at normal operating potentials, the breakdown would not occur more frequently than perhaps once per 100 hours of operation (for 2,000 resistors in an accelerator, this would mean one gap breakdown per 3 minutes).

However, the gap is expected to break down within a microsecond during a transient produced by an accelerator discharge. To effect this, the potential difference across the gap must increase several times the normal working potential difference. Typically, this increase is 2 or 3 times the normal working potential difference. If the resistor is directly connected across the gap, it, too, would experience the same increased potential difference, and turn-to-turn sparking would occur within the resistor element.

In my novel resistor device, the spring 29 in the fixed end cap 23 acts as an inductor in series with the resistor element 20. This arrangement, together with the resistance to tube wall distributed capacitance, limits the rise of potential across the resistor before the spark gap conducts to a safe value so that the manufacturer's peak rating is not exceeded. During the pre-breakdown time of the spark gap, the external transient produces a large potential difference across the spring 29, and the insulating bushing 32 serves to permit the resistor end to be, at this moment, at a different potential than the tube wall. In theory, an inductance could also be provided by the spring 44 for the movable end cap 34; however, mechanical constraints make it impractical to provide an insulating end support of sufficient thickness to avoid electrical breakdown at the expected transient potentials. Consequently, the resistor support at this end is in intentional electrical contact with the movable end cap 34.

It is self-evident that, due to the electrical power dissipation, resistors become warmer than their surroundings and, therefore, will expand relative to the associated mountings. This effect is usually of no concern, as even the soldered post-mounting provides sufficient flexibility to avoid serious problems on this account. What is not so obvious is that, due to the forces produced by the electric field in the ceramic body of a resistor, the resistor has mechanical strain present in it during normal operation. In addition, if the ceramic material exhibits any piezoelectric effect, the strain is increased by orders of magnitude. When the spark gap conducts, the electrical field is instantly removed (on a microsecond time scale) and the strain is released. This produces a sudden change of length in the resistor body. If the resistor is firmly attached to a massive support, then a compression mode shock wave is propagated through the resistor body. Repeated spark breakdown under these conditions tends to produce mechanical fatigue of the resistor, as shown by intermittent contact between the resistor element and the end cap connections, and, in some cases, by fracture of the resistor at some initial crack in the ceramic body, which has propagated until it becomes total.

The use of coil springs for mounting opposite ends of the resistor element 20 substantially reduces, if not eliminates, the problems associated with resistors attached firmly to supports and subject to overvoltage transients. The novel resistor device 18 is, therefore, well-suited for its intended application, namely, to be used in a situation in which overvoltage transients and spark gap breakdown occur at regular intervals.

Normally, many hundreds of such resistors are mounted in close proximity to form the accelerator divider chain. From time to time, one of the resistor spark gaps discharges, either due to probability reasons, or due to a small wave propagating along the accelerator structure. This is generally of little consequence, providing there is no more than a momentary interruption of the accelerator. However, it is desirable that such a single resistor discharge should not propagate to adjacent resistors, and then to a complete discharge of the accelerator. One mode of propagation is a wave of the electrical disturbance created by the abrupt discharge of the electrode pair associated with the resistor. Little can be done to eliminate transient waves on the accelerator structure from this cause.

However, the second cause of propagation of a single discharge to adjacent structures is by ultra-violet light from the discharge impinging on the surfaces of the adjacent spark gaps. At the adjacent surfaces gap, the light releases photoelectrons, which travel across the gap, ionizing the gas and causing the gap to spark. Light from this gap then impinges on the next gaps and the process repeats itself until the machine or accelerator is completely discharged. To avoid this, the spark of a discharging gap should be out of sight of adjacent gaps. This can be achieved in some configuration by mounting the resistors and their external gaps in a staggered assembly, but in my novel resistor device, the spark gap 54 is intentionally hidden from the outside of the resistor housing. Thus, only scattered light from the movable end cap 34 is released from this housing region during breakdown of the spark gap 54. This represents a reduction of several orders of magnitude in the density of ultra-violet photons available to ionize adjacent spark gaps. It is also pointed out that the external surfaces of the movable end cap 34 can be surface treated to further reduce the reflectivity.

From the foregoing, it will be seen that I have provided a novel resistor device, of simple and inexpensive construction, which overcomes many of the problems involved with grading resistors caused by severe electrical transients in electromagnetic particle accelerators.

What is claimed is:

1. A resistor device for use with an electrostatic particle accelerator having a plurality of apertured axially spaced apart electrode plates and a plurality of annular insulators, each insulator being positioned between a pair of electrode plates, said resistor device comprising:

an elongate tubular housing formed of electrically conductive material, a fixed end cap formed of conductive material and being connected to one end of said tubular housing, a movable end cap formed of conductive material spaced radially inwardly and projecting interiorly of the tubular housing at the other end of the latter, non-conductive means mounted within said tubular housing and slidably supporting said movable end cap for axial movement of the latter relative to said tubular housing, an elongate cylindrical resistor element, means engaging said resistor element and positioning the latter in inwardly spaced concentric relation within the tubular housing, said tubular housing and end caps defining an electromagnetic shield substantially shielding the resistor element from the exterior, resilient means in said tubular housing engaging said fixed end cap and said resistor element for permitting yieldable axial movement of the latter relative to the housing, an annular conducting element electrically connected to said other end of the tubular housing and being spaced radially outwardly of the movable cap and defining an annular spark gap with the latter, and means electrically connecting the ends of said resistor element with the movable and fixed end caps whereby, when said resistor device is electrically connected through the end caps across a pair of adjacent electrode plates of an electrostatic particle accelerator, severe electrical transients will be conducted to said resistor device.

2. The resistor device as defined in claim 1 wherein said means electrically connecting the fixed end cap with an end of said resistor element includes said yieldable means.

3. The resistor device as defined in claim 2 wherein said yieldable means comprises a helical spring which serves as an inductor in series with the resistor element when said resistor device is energized by a severe electrical transient.

4. The resistor device as defined in claim 1 and resilient means engaging said movable end cap and said resistor element.

5. The resistor device as defined in claim 3 and a bushing formed of insulating material positioned within said tubular housing at one end thereof adjacent said fixed end cap, said positioning means including a disk formed of conductive material positioned within and engaging said bushing, said disk electrically connecting said resilient means with said resistor element whereby, when said resistor device is energized by a severe electrical transient, said resistor element adjacent said fixed end cap will be at a different potential than the tubular housing.

6. In combination with an electrostatic particle accelerator having a plurality of apertured axially spaced apart electrode plates and a plurality of annular insulators, each insulator being positioned between a pair of electrode plates, a plurality of resistor devices, each including an elongate tubular housing formed of electrically conductive material, a fixed end cap formed of conductive material and being connected to one end of said tubular housing, a movable end cap formed of conductive material spaced radially inwardly and projecting interiorly of the tubular housing at the other end of the latter, non-conductive means mounted within said tubular housing and slidably supporting said movable end cap for axial movement of the latter relative to said tubular housing, an elongate cylindrical resistor element, means engaging said resistor element and positioning the latter in inwardly spaced concentric relation within the tubular housing, said tubular housing and end caps defining an electromagnetic shield substantially shielding the resistor element from the exterior, resilient means in said tubular housing engaging said fixed end cap and said resistor element for permitting yieldable axial movement of the latter relative to the housing, an annular conducting element electrically connected to said other end of the tubular housing and being spaced radially outwardly of the movable cap and defining an annular spark gap with the latter, and means electrically connecting the ends of said resistor element with the movable and fixed end caps whereby, when each of said resistor devices is electrically connected through the end caps across a pair of adjacent electrode plates of an electrostatic particle accelerator, severe electrical transients will be conducted to said resistor devices.

7. The invention as defined in claim 6 wherein said means electrically connecting the fixed end cap with an end of said resistor element includes a helical spring which serves as an inductor in series with the resistor element when said resistor device is energized by a severe electrical transient.

8. The resistor device as defined in claim 7 and resilient means engaging said movable end cap and said resistor element.

9. The resistor device as defined in claim 8 and a bushing formed of insulating material positioned within said tubular housing at one end thereof adjacent said fixed end cap, said positioning means including a disk formed of conductive material positioned within and engaging said bushing, said disk electrically connecting said resilient means with said resistor element whereby, when said resistor device is energized by a severe electrical transient, said resistor element adjacent said fixed end cap will be at a different potential than the tubular housing.

* * * * *